US005221658A

United States Patent [19]

Bach et al.

[11] Patent Number: 5,221,658

[45] Date of Patent: Jun. 22, 1993

[54] TRANSFER OF INDOANILINE DYES

[75] Inventors: Volker Bach, Neustadt; Ruediger Sens, Mannheim; Karl-Heinz Etzbach, Frankenthal, all of Fed. Rep. of Germany

[73] Assignee: BASF Aktiengesellschaft, Ludwigshafen, Fed. Rep. of Germany

[21] Appl. No.: 760,139

[22] Filed: Sep. 16, 1991

[30] Foreign Application Priority Data

Oct. 4, 1990 [DE] Fed. Rep. of Germany ..... 4031255

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,857,503 8/1989 Jongewaard et al. ..... 503/227

FOREIGN PATENT DOCUMENTS 0366963 5/1990 European Pat. Off. ..... 503/227
0415203 3/1991 European Pat. Off. ..... 503/227
0416434 3/1991 European Pat. Off. ..... 503/227
2219693 9/1990 Japan ..... 503/227

OTHER PUBLICATIONS

Japan Abstract, 109341, May 23, 1985, & JP-A-26-8-493, Nov. 27, 1986.

Japan Abstract, 077529, Mar. 30, 1988, & JP-A-249860, Oct. 5, 1989.

Patent Abstracts of Japan, vol. 14, No. 277 (M-985) (4220) Jun. 15, 1990 & JP-A-2 084 388 (Hitachi Ltd.) Mar. 26, 1990 summary.

Patent Abstracts of Japan, vol. 9, No. 36 (C-266) (1759) Feb. 15, 1985 & JP-A-59 182 839 (Konishiroku Shashin Kogyo K.K.) Oct. 17, 1984 summary.

*Primary Examiner*—B. Hamilton Hess

*Attorney, Agent, or Firm*—Oblon, Spivak, McClelland, Maier & Neustadt

[57] ABSTRACT

One or more indoaniline dyes are transferred from a transfer to a sheet of plastic-coated paper by diffusion or sublimation with the aid of an energy source, said indoaniline dyes having the formula

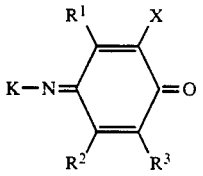

where $R^1$, $R^2$ and $R^3$ are each independently of the others hydrogen, methyl, fluorine or chlorine, X is fluorine or chlorine, and K is an aromatic radical.

1 Claim, No Drawings

TRANSFER OF INDOANILINE DYES

The present invention relates to a novel process for transferring indoaniline dyes from a transfer to a sheet of plastic-coated paper with the aid of an energy source.

In the thermotransfer printing process, a transfer sheet which contains a thermally transferable dye in one or more binders on a support, with or without suitable assistants, is heated from the back with an energy source, for example a thermal printing head or a laser, in short pulses (lasting fractions of a second), causing the dye to migrate out of the transfer sheet and diffuse into the surface coating of a receiving medium. The essential advantage of this process is that the amount of dye to be transferred (and hence the color gradation) is readily controllable through adjustment of the energy to be emitted by the energy source.

In general, color recording is carried out using the three subtractive primaries yellow, magenta and cyan (with or without black).

To ensure optimal color recording, the dyes must have the following properties:

- ready thermal transferability,
- little tendency to migrate within or out of the surface coating of the receiving medium at room temperature,
- high thermal and photochemical stability and resistance to moisture and chemical substances,
- suitable hues for subtractive color mixing,
- a high molar absorption coefficient,
- no tendency to crystallize out on storage of the transfer sheet.

These requirements are very difficult to meet at one and the same time as is known from experience.

For this reason most of the existing thermal transfer dyes, in particular those for cyan, do not have the required combination of properties.

JP-A-268 493/1986 and JP-A-249 860/1989 disclose transferring those indoaniline dyes where the coupling component is derived from aniline derivatives and which besides chlorine have methyl and ethoxycarbonylamino or methylamino and butylcarbonylamino as further substituents on the indoaniline moiety. However, it has been found that these dyes do not give adequate results.

It is an object of the present invention to provide a novel process for the transfer of indoaniline dyes in which the dyes used shall have the properties mentioned at the beginning.

We have found that this object is achieved by a process for transferring indoaniline dyes from a transfer to a sheet of plastic-coated paper by diffusion or sublimation with the aid of an energy source, which comprises using a transfer on which there is or are one or more dyes of the formula I

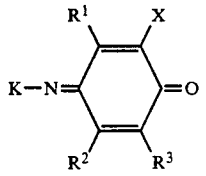

(I)

where $R^1$, $R^2$ and $R^3$ are identical or different and each is independently of the others hydrogen, methyl, fluorine or chlorine, X is fluorine or chlorine, and K is an aromatic carbocyclic or heterocyclic radical.

Suitable aromatic carbocyclic or heterocyclic radicals K are derived for example from compounds of the aniline, indole or quinoline series.

Emphasis must be given to a process in which there is or are on the transfer one or more dyes of the formula I where K is a radical of the formula

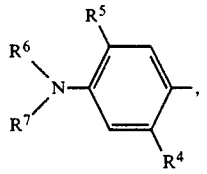

(IIa)

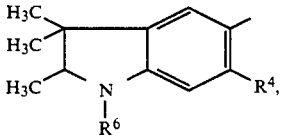

(IIb)

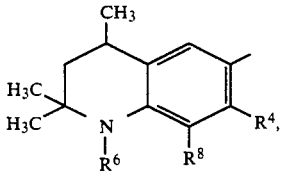

(IIc)

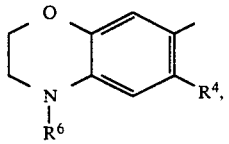

(IId)

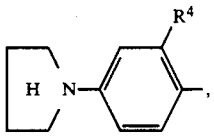

(IIe)

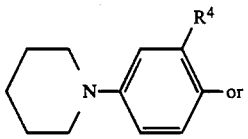

(IIf)

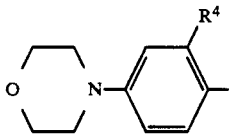

(IIg)

where $R^4$ is hydrogen, methyl, methoxy, $C_1$-$C_4$-mono- or -dialkylaminosulfonylamino, $C_1$-$C_4$-alkylsulfonylamino or the radical —$NHCOR^9$ or —$NHCO_2R^9$, where $R^9$ is phenyl, benzyl, tolyl or $C_1$-$C_8$-alkyl which may be interrupted by one or two oxygen atoms in ether function, $R^5$ is hydrogen, methoxy or ethoxy, $R^6$ and $R^7$ are identical or different and each is independently of the other hydrogen, $C_1$–$C_8$-alkyl, which may be substituted and which may be interrupted by one or two oxygen atoms in ether function, or $C_5$–$C_7$ -cycloalkyl, and $R^8$ is hydrogen, methyl or methoxy.

Any alkyl appearing in the abovementioned formulae IIa to IIg may be either straight-chain or branched.

Any substituted alkyl appearing in the abovementioned formulae IIa to IIg may have as substituents for example cyano, phenyl, tolyl, hydroxyl, $C_1$–$C_6$-alkanoyloxy, $C_1$–$C_4$-alkoxycarbonyl or $C_1$–$C_4$-alkoxycarbonyloxy, for which in the last-mentioned case the alkoxy group may be substituted by phenyl or $C_1$–$C_4$-alkoxy.

Suitable $R^2$, $R^6$, $R^7$ and $R^9$ radicals are for example methyl, ethyl, propyl, isopropyl, butyl, isobutyl and sec-butyl.

$R^6$, $R^7$ and $R^9$ may each also be for example pentyl, isopentyl, neopentyl, tert-pentyl, hexyl, 2-methylpentyl, heptyl, octyl, 2-ethylhexyl, 2-methoxyethyl, 2- or 3-methoxypropyl, 2-ethoxyethyl, 2- or 3-ethoxypropyl, 2-propoxyethyl, 2- or 3-propoxypropyl, 2-butoxyethyl, 2- or 3-butoxypropyl, 3,6-dioxaheptyl or 3,6-dioxaoctyl.

$R^6$ and $R^7$ may each also be for example 2-cyanoethyl, 2- or 3-cyanopropyl, 2-acetyloxyethyl, 2- or 3-acetyloxypropyl, 2-isobutyryloxyethyl, 2- or 3-isobutyryloxypropyl, 2-methoxycarbonylethyl, 2- or 3-methoxycarbonylpropyl, 2-ethoxycarbonylethyl, 2- or 3-ethoxycarbonylpropyl 2-methoxycarbonyloxyethyl, 2- or 3-methoxycarbonyloxypropyl, 2-ethoxycarbonyloxyethyl, 2- or 3-ethoxycarbonyloxypropyl, 2-butoxycarbonyloxyethyl, 2- or 3-butoxycarbonyloxypropyl, 2-(2-phenylethoxycarbonyloxy)ethyl, 2- or 3-(2-phenylethoxycarbonyloxy)propyl, 2-(2-ethoxyethoxycarbonyloxy)ethyl, 2- or 3-(2-ethoxyethoxycarbonyloxy)propyl, benzyl, 2-methylbenzyl, 1- or 2-phenylethyl, cyclopentyl, cyclohexyl or cycloheptyl.

$R^4$ is for example mono- or dimethylaminohylaminosulfonylamino, mono- or diethylaminosulfonylamino, mono- or dipropylaminosulfonylamino, mono- or diisopropylaminosulfonylamino, mono- or dibutylaminosulfonylamino, (N-methyl-N-ethylaminosulfonyl)amino, methylsulfonylamino, ethylsulfonylamino, propylsulfonylamino, isopropylsulfonylamino or butylsulfonylamino.

Preference is given to a process in which there is or are on the transfer one or more dyes of the formula I where K is a radical of the formula IIa or IIc.

Of particular interest is a process in which there is or are on the transfer one or more dyes of the formula III

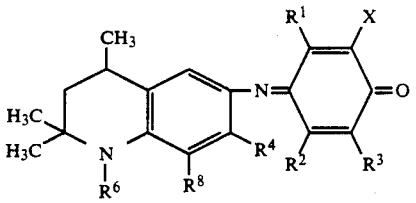

(III)

where $R^4$ is hydrogen, methyl or acetylamino, $R^6$ is hydrogen, $C_1$–$C_6$-alkyl which may be substituted and/or interrupted by one or two oxygen atoms in the ether function, or $C_5$–$C_7$-cycloalkyl, and $R^8$ is hydrogen, and $R^1$, $R^2$, $R^3$ and X are each as defined above.

Also of particular interest is a process in which there is or are on the transfer one or more dyes of the formula IV

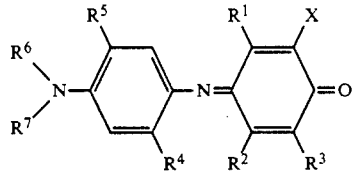

(IV)

where $R^4$ is hydrogen, methyl or acetylamino, $R^5$ is hydrogen, and $R^6$ and $R^7$ are each independently of the other hydrogen or $C_1$–$C_6$-alkyl which may be substituted by cyano, $C_1$–$C_6$-alkanoyloxy, $C_1$–$C_4$-alkoxycarbonyl or $C_1$–$C_4$-alkoxycarbonyloxy or interrupted by one oxygen atom in ether function, and $R^1$, $R^2$, $R^3$and X are each as defined above.

Particular preference is given to a process in which there is or are on the transfer one or more dyes of the formula I where $R^1$ and $R^2$ are each hydrogen or methyl and $R^3$ and X are each chlorine.

The indoaniline dyes of the formula I can be prepared by methods known per se, for example as described in earlier Patent Applications EP-A-416434 and EP Application No. 91104408.9.

Compared with the dyes used in existing processes, the dyes of the formula I which are transferred in the process of the present invention generally possess improved migration properties in the receiving medium at room temperature, readier thermal transferability, higher thermal and photochemical stability, readier industrial accessibility, better resistance to moisture and chemical substances, higher color strength, better solubility or better suitability for subtractive color mixing (higher purity of hue, more advantageous shape of absorption bands, e.g. low half-value width or greater steepness on the short-wave side). They are also particularly advantageously suitable for dye mixtures with triazolopyridine dyes as described in earlier Patent Application EP-A-416434. This is true in the main in respect of better transferability, higher inked ribbon stability (better compatibility with binder) higher light fastness, better distribution of the transfer dyes in the receiving medium and in particular the preparation of better black mixtures.

To prepare the dye transfers required for the process of the present invention, the dyes are dissolved in a suitable organic solvent or in mixtures of solvents together with one or more binders and possible assistants to form a printing ink in which the dye is preferably present in a molecularly dispersed, ie. dissolved, form. The printing ink can then be applied to the inert support by knife coating and air dried.

Suitable binders are all resins or polymer materials which are soluble in organic solvents and capable of binding the dye to the inert support in a form in which it will not rub off. Preference is given here to those binders which, after the printing ink has been air dried, hold the dye in a clear, transparent film in which no visible crystallization of the dye occurs.

Examples of such binders are cellulose derivatives, eg. methylcellulose, ethylcellulose, ethylhydroxyethylcellulose, hydroxypropylcellulose, cellulose acetate or cellulose acetobutyrate, starch, alginates, alkyd resins, vinyl resins, polyvinyl alcohol, polyvinyl acetate, polyvinyl butyrate and polyvinylpyrrolidone. It is also possible to use polymers and copolymers of acrylates or their derivatives, such as polyacrylic acid, polymethyl methacrylate or styrene-acrylate copolymers, polyester resins, polyamide resins, polyurethane resins or natural CH resins such as gum arabic. Further suitable binders are described for example in DE-A-3 524 519.

Preferred binders are cellulose derivatives and polyvinyl butyrate.

The ratio of binder to dye may vary, preferably from 1:1 to 5:1.

Possible assistants are release agents as mentioned in EP-A-227 092, EP-A-192 435 and the patent applications cited therein, but also in particular organic additives which prevent the transfer dyes from crystallizing out in the course of storage and heating of the inked ribbon, for example cholesterol or vanillin.

Inert support materials are for example tissue, blotting or parchment paper and plastics films possessing good heat resistance, for example metallized or unmetallized polyester, polyamide or polyimide. The inert support may additionally be coated on the side facing the energy source with a lubricant or slipping layer in order that adhesion of the energy source, in particular the thermal printing head, to the support material may be prevented. Suitable lubricants are described for example in EP-A-216 483 and EP-A-227 095. The thickness of the support for the dye is in general from 3 to 30 μm, preferably from 5 to 10 μm.

The dye-receiving layer can be basically any heat resistant plastics layer which possesses affinity for the dyes to be transferred, for example a modified polycarbonate or polyester. Suitable recipes for the receiving layer composition are described in detail for example in EP-A-227 094, EP-A-133 012, EP-A-133 011, EP-A-111 004, JP-A-199 997/1986, JP-A-283 595/1986, JP-A-237 694/1986 and JP-A-127 392/1986.

The transfer process is effected by means of an energy source, eg. by means of a laser or a thermal printing head, it being necessary for the latter to be heatable to a >300° C. in order that the transfer of dye may take place within the time range t: $0<t<15$ msec. In the course of transfer, the dye migrates out of the transfer sheet and diffuses into the surface coating of the receiving medium.

Further details may be discerned from the Examples which follow, in which the percentages are by weight, unless otherwise stated. Transfer of dyes For a simple quantitative examination of the transfer characteristics of the dyes, the thermal transfer was effected with large hotplates, the transfer temperature being varied within the range 70° C.<T<120° C. while the transfer time was fixed at 2 minutes.

α) General recipe for coating the support with dye 1 g of binder was dissolved in 8 ml of 8:2 v/v toluene/ethanol at 40–50° C. A solution of 0.5 g of dye in 30 ml of tetrahydrofuran was added with stirring and, if necessary, the insoluble reside was filtered off. The print paste thus obtained was applied with an 80 μm doctor blade to a polyester sheet (thickness: 6–10 μm) and dried with a hair dryer.

β) Testing of thermal transferability

The dyes used were tested as follows:

The polyester sheet donor containing the in-test dye in the coated front was placed face down on a sheet of commercially available Hitachi color video print paper receptor and pressed down. Donor/receptor were then wrapped in aluminum foil and heated between two hotplates at various temperatures T (within the temperature range 70° C.<T<120° C.). The amount of dye diffusing into the bright plastics layer of the receptor is proportional to the optical density (=absorbance A). The latter was determined photometrically. The plots of the logarithm of the absorbance A of the colored receptor papers measured within the temperature range from 80 to 110° C. against the reciprocal of the corresponding absolute temperature are straight lines from whose slope it is possible to calculate the activation energy $\Delta E_T$ for the transfer experiment:

$$\Delta E_T = 2,3 \cdot R \cdot \frac{\Delta \log A}{\Delta\left[\frac{1}{T}\right]}$$

To complete the characterization, the plots additionally reveal the temperature T*[° C.] at which the absorbance A of the colored receptor papers attains the value 1.

The dyes listed below in the tables were processed according to α) and the dye-coated transfers obtained were tested for their transfer characteristics according to β). The tables show in each case the thermotransfer parameters T* and $\Delta E_T$, the absorption maxima $\lambda_{max}$ and the binders used:

The key to the abbreviations is as follows:

B=binder

EC=ethylcellulose

EHEC=ethylhydroxyethylcellulose

MX=mixture of polyvinyl butyrate and ethylcellulose in a weight ratio of 2:1

TABLE 1

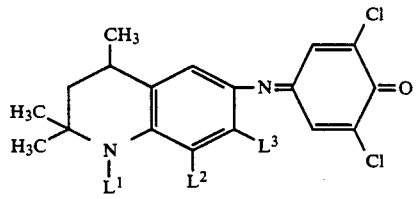

| Bsp. Nr. | $L^1$ | $L^2$ | $L^3$ | B | $\lambda_{max}$ a) [nm] | T* [°C.] | $\Delta E_T \left[\frac{kcal}{mol}\right]$ |
|---|---|---|---|---|---|---|---|
| 1 | $C_2H_5$ | H | $CH_3$ | EHEC | 691 | 81 | 18 |
| 2 | $CH_3$ | $CH_3$ | H | EC | 662 | 84 | 22 |
| 3 | $CH_3$ | H | $CH_3$ | EC | 688 | 86 | 18 |

TABLE 1-continued

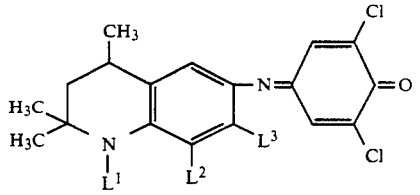

| Bsp. Nr. | $L^1$ | $L^2$ | $L^3$ | B | $\lambda_{max}$ a) [nm] | T* [°C.] | $\Delta E_T \left[\frac{kcal}{mol}\right]$ |
|---|---|---|---|---|---|---|---|
| 4 | H | $OCH_3$ | H | EC | 683 | 86 | 19 |
| 5 | $C_2H_4—O—C_4H_9$ | H | $CH_3$ | EC | 685 | 90 | 20 |
| 6 | H | H | $NHCOCH_3$ | EC | 671 | 89 | 19 |
| 7 | H | H | $CH_3$ | EHEC | 661 | 82 | 17 |

a) measured in acetone

TABLE 2

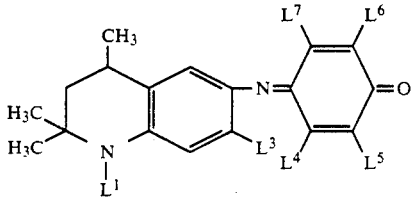

| Ex. No. | $L^1$ | $L^3$ | $L^4$ | $L^5$ | $L^6$ | $L^7$ | B | $\lambda_{max}$ b) [nm] | T* [°C.] | $\Delta E_T \left[\frac{kcal}{mol}\right]$ |
|---|---|---|---|---|---|---|---|---|---|---|
| 8 | $CH_3$ | $CH_3$ | $CH_3$ | Cl | H | $CH_3$ | MS | 658 | 95 | 14 |
| 9 | $CH_3$ | $CH_3$ | $CH_3$ | H | Cl | H | MS | 647 | 97 | 18 |
| 10 | $CH_3$ | $CH_3$ | Cl | H | Cl | H | MS | 676 | 100 | 16 |
| 11 | $CH_3$ | $CH_3$ | H | H | F | H | MS | 638 | 95 | 15 |
| 12 | $CH_3$ | $CH_3$ | H | Cl | F | H | MS | 671 | 98 | 16 |
| 13 | $C_2H_5$ | H | $CH_3$ | Cl | H | $CH_3$ | MS | 646 | 89 | 16 |
| 14 | $C_2H_5$ | H | $CH_3$ | H | Cl | H | EC | 635 | 82 | 17 |
| 15 | $C_2H_5$ | H | Cl | H | Cl | H | MS | 666 | 100 | 16 |
| 16 | $C_2H_5$ | H | H | H | F | H | MS | 623 | 91 | 13 |
| 17 | $C_2H_5$ | H | H | Cl | F | H | MS | 655 | 95 | 16 |
| 18 | $C_2H_4CO_2C_2H_5$ | H | $CH_3$ | Cl | H | $CH_3$ | MS | 633 | 102 | 13 |
| 19 | $C_2H_4CO_2C_2H_5$ | H | $CH_3$ | H | Cl | H | MS | 623 | 101 | 11 |
| 20 | $C_2H_4CO_2C_2H_5$ | H | Cl | H | Cl | H | MS | 655 | 104 | 14 |
| 21 | $C_2H_4CO_2C_2H_5$ | H | H | H | F | H | MS | 612 | 96 | 13 |
| 22 | $C_2H_4CO_2C_2H_5$ | H | H | Cl | F | H | MS | 643 | 93 | 14 |

b) measured in tetrahydrofuran

TABLE 3

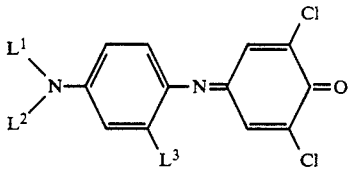

| Ex. No. | $L^1$ | $L^2$ | $L^3$ | B | $\lambda_{max}$ a) [nm] | T* [°C.] | $\Delta E_T \left[\frac{kcal}{mol}\right]$ |
|---|---|---|---|---|---|---|---|
| 23 | $C_2H_4CN$ | $C_4H_9$ | H | EC | 630 | 94 | 20 |
| 24 | $C_2H_5$ | $C_2H_4—OCH_3$ | $CH_3$ | EC | 668 | 80 | 16 |
| 25 | $CH_3$ | $C_2H_4—O—\overset{O}{\overset{\|\|}{C}}—O—C_2H_4C_6H_5$ | H | EC | 635 | 83 | 15 |
| 26 | $C_2H_4CN$ | $C_2H_4—O—\overset{O}{\overset{\|\|}{C}}—OCH_3$ | H | EC | 614 | 90 | 17 |
| 27 | $C_2H_5$ | $C_2H_5$ | $NHCOCH_3$ | EHEC | 661 | 84 | 19 |

TABLE 3-continued

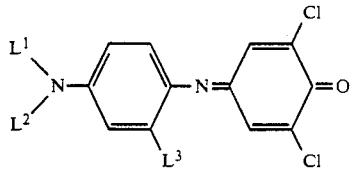

| Ex. No. | $L^1$ | $L^2$ | $L^3$ | B | $\lambda_{max}$[a] [nm] | T* [°C.] | $\Delta E_T$ [kcal/mol] |
|---|---|---|---|---|---|---|---|
| 28 | $CH_2C_6H_5$ | $C_2H_4O-\overset{O}{\overset{\|\|}{C}}-OC_2H_4OC_2H_5$ | H | EC | 628 | 87 | 18 |
| 29 | $C_2H_5$ | $C_2H_5$ | H | EHEC | 654 | 74 | 15 |
| 30 | $C_2H_5$ | $C_2H_4O-\overset{O}{\overset{\|\|}{C}}CH_3$ | H | EC | 640 | 80 | 16 |
| 31 | $C_2H_5$ | $C_2H_4O-\overset{O}{\overset{\|\|}{C}}-OCH_3$ | H | EHEC | 638 | 82 | 18 |
| 32 | $C_2H_4OH$ | $C_2H_5$ | $CH_3$ | EC | 672 | 90 | 20 |
| 33 | $C_2H_5$ | $C_2H_4CN$ | $CH_3$ | EC | 649 | 88 | 19 |
| 34 | $C_2H_5$ | $C_2H_4CN$ | H | MS | 628 | 87 | 17 |
| 35 | $C_2H_4CN$ | $C_2H_4CN$ | $CH_3$ | EC | 622 | 92 | 18 |
| 36 | $C_2H_4OH$ | $C_2H_5$ | H | EC | 652 | 86 | 17 |
| 37 | $C_4H_9$ | $C_4H_9$ | H | MS | 673[b] | 75 | 16 |
| 38 | $C_4H_9$ | $C_4H_9$ | $CH_3$ | EC | 676 | 77 | 17 |

[a]measured in acetone
[b]measured in methylene chloride

TABLE 4

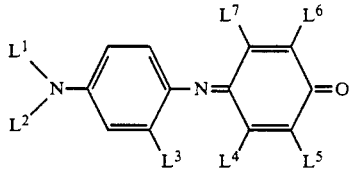

| Ex. No. | $L^1$ | $L^2$ | $L^3$ | $L^4$ | $L^5$ | $L^6$ | $L^7$ | B | $\lambda_{max}$ [nm] | T* [°C.] | $\Delta E_T$ [kcal/mol] |
|---|---|---|---|---|---|---|---|---|---|---|---|
| 39 | $C_2H_5$ | $C_2H_5$ | $NHCOCH_3$ | H | $CH_3$ | Cl | H | EC | 630[a] | 82 | 19 |
| 40 | $C_2H_5$ | $C_2H_5$ | $NHCOCH_3$ | $CH_3$ | H | Cl | H | EC | 639[a] | 84 | 18 |
| 41 | $CH_3$ | $CH_3$ | H | H | $CH_3$ | Cl | H | MS | 603[a] | 83 | 16 |
| 42 | $C_2H_5$ | $C_2H_5$ | H | H | $CH_3$ | Cl | H | EC | 616[a] | 80 | 15 |
| 43 | $NC-C_2H_4$ | $C_4H_9$ | H | H | $CH_3$ | Cl | H | EC | 624[a] | 86 | 17 |
| 44 | $NC-C_2H_4$ | $NC-C_2H_4$ | $CH_3$ | H | $CH_3$ | Cl | H | EC | 588[a] | 94 | 19 |
| 45 | $C_2H_5$ | $CH(CH_3)_2$ | H | $CH_3$ | H | Cl | H | MS | 633[b] | 80 | 16 |
| 46 | $C_2H_5$ | $CH(CH_3)_2$ | H | Cl | H | Cl | H | MS | 661[b] | 90 | 14 |
| 47 | $C_2H_5$ | $CH(CH_3)_2$ | H | H | F | Cl | H | MS | 656[b] | 79 | 13 |
| 48 | $C_2H_5$ | $C_2H_5$ | $NHCO_2CH_3$ | $CH_3$ | H | Cl | H | EC | 633[b] | 94 | 16 |
| 49 | $C_2H_5$ | $C_2H_5$ | $NHCO_2CH_3$ | Cl | H | Cl | H | MS | 639[b] | 96 | 13 |
| 50 | $C_2H_5$ | $C_2H_5$ | $NHCOCH_3$ | $CH_3$ | H | Cl | H | MS | 638[b] | 90 | 15 |
| 51 | $C_2H_5$ | $C_2H_5$ | $NHCOCH_3$ | Cl | H | Cl | H | MS | 640[b] | 91 | 16 |
| 52 | $C_2H_5$ | $C_2H_4OCH_3$ | $CH_3$ | $CH_3$ | H | Cl | H | MS | 630[b] | 93 | 13 |
| 53 | $C_2H_5$ | $C_2H_4OCH_3$ | $CH_3$ | Cl | H | Cl | H | MS | 658[b] | 95 | 17 |
| 54 | $C_2H_5$ | $C_2H_4OCH_3$ | $CH_3$ | H | F | Cl | H | MS | 652[c] | 90 | 15 |
| 55 | $C_2H_5$ | $C_2H_4OCH_3$ | $CH_3$ | $CH_3$ | H | Cl | $CH_3$ | EC | 639[c] | 90 | 12 |
| 56 | $C_2H_5$ | $C_2H_5$ | $NHCOCH_3$ | $CH_3$ | H | Cl | $CH_3$ | EC | 653[c] | 94 | 13 |
| 57 | $C_2H_5$ | $C_2H_5$ | $NHCO_2CH_3$ | $CH_3$ | H | Cl | $CH_3$ | EC | 648[c] | 93 | 14 |
| 58 | $C_2H_5$ | $C_2H_4OCH_3$ | $CH_3$ | H | H | F | H | EC | 620[c] | 85 | 14 |

[a]measured in acetone
[c]measured in tetrahydrofuran

We claim:

1. A process for transferring indoaniline dyes from a transfer sheet to a plastic-coated receiving medium comprising heating the transfer sheet, wherein on the transfer sheet is or are one or more dyes of the formula I

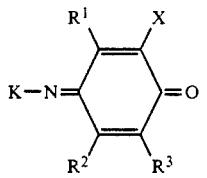

(I)

where $R^1$, $R^2$ and $R^3$ are identical or different and each is independently of the others hydrogen, methyl, fluorine or chlorine, X is fluorine or chlorine and K is

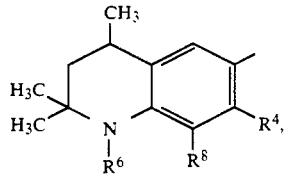

(IIc)

where $R^4$ is hydrogen, methyl, methoxy, $C_1$–$C_4$-mono- or -dialkylaminosulfonylamino, $C_1$–$C_4$ alkylsulfonylamino or the radical —NHCOR$^9$ or —NH-CO$_2$r$^9$, where $R^9$ is phenyl, benzyl, tolyl or $C_1$–$C_8$ alkyl which may be interrupted by one or two oxygen atoms in ether function, $R^5$ is hydrogen, methoxy, or ethoxy, $R^6$ is hydrogen, $C_1$–$C_8$-alkyl, which may be substituted and which may be interrupted by one or two oxygen atoms in ether function, or $C_5$–$C_7$-cycloalkyl, and $R^8$ is hydrogen, methyl or methoxy.

* * * * *